US008967623B1

(12) United States Patent
Ortquist

(10) Patent No.: US 8,967,623 B1
(45) Date of Patent: Mar. 3, 2015

(54) BEVERAGE GAME PLAYING TABLE HAVING MOVING WATER TROUGHS

(71) Applicant: Bryan D. Ortquist, Beacon, NY (US)

(72) Inventor: Bryan D. Ortquist, Beacon, NY (US)

( * ) Notice: Subject to any disclaimer, the term of this patent is extended or adjusted under 35 U.S.C. 154(b) by 343 days.

(21) Appl. No.: 13/648,211

(22) Filed: Oct. 9, 2012

Related U.S. Application Data

(60) Provisional application No. 61/545,102, filed on Oct. 7, 2011.

(51) Int. Cl.
*A63B 67/00* (2006.01)
*A63B 63/00* (2006.01)

(52) U.S. Cl.
USPC ..... 273/342; 473/496

(58) Field of Classification Search
USPC ..... 273/309, 340–342; 473/496; 108/25
See application file for complete search history.

(56) References Cited

U.S. PATENT DOCUMENTS 4,762,327 A * 8/1988 Gomez ..... 273/309
5,704,640 A * 1/1998 Monk et al. ..... 280/741
5,772,535 A * 6/1998 Murphy ..... 473/415
7,325,807 B1 2/2008 Eason
8,006,980 B1 * 8/2011 Herro et al. ..... 273/342
8,176,745 B1 * 5/2012 Korza et al. ..... 62/258
2004/0188942 A1 * 9/2004 Trokan ..... 273/342
2006/0027971 A1 * 2/2006 Radhakrishnan ..... 273/309
2006/0226606 A1 10/2006 Finley et al.
2009/0249984 A1 10/2009 Meyer
2010/0244384 A1 9/2010 Hoffer

* cited by examiner

*Primary Examiner* — Nini Legesse
(74) *Attorney, Agent, or Firm* — Calhelha & Doyle LLC

(57) ABSTRACT

The subject game table apparatus comprises a generally flat play surface configured for placement between opposing players. The play surface is preferably rectangular in shape and is equipped with at least one water trough set into a channel in the top side of the table. The trough is parallel and proximal to a side edge of the table and near but outside of a generally central play area. The water trough has a drain at one end and a nozzle at the opposite end of the trough, such that liquid will flow from the nozzle end of the trough to the drain end. The trough is configured to collect and rinse thrown play pieces, usually balls, and return such objects to a player located near the drain end of the trough. The trough further has a liquid pump and tubing configured to convey flowing water from the trough drain to the opposite nozzle, for recirculation.

19 Claims, 5 Drawing Sheets

60
61
62
63
64
65
66
67
70
71

BEVERAGE GAME PLAYING TABLE HAVING MOVING WATER TROUGHS

CROSS-REFERENCE TO RELATED APPLICATION

This application claims the benefit of provisional application Ser. No. 61/545,102 filed Oct. 7, 2011 which is incorporated herein by reference.

FIELD OF THE INVENTION

The present invention relates to gaming tables modified with running water troughs to be used for games involving beverages, lightweight cups and balls.

BACKGROUND OF THE INVENTION

It is well-known to play a game involving ping pong balls, a long table and a number of cups filled with beverages at many social gatherings. There are a variety of iterations and variations on the concept, allowing for a diverse and fun experience in a variety of settings, such as game rooms, party rooms, outside and even pools.

Typically the standard game play involves two players or two teams, who attempt to throw or bounce ping pong balls across a table into the opponent's cup. If successful, the opponent must drink the contents of the cup. This game is frequently played by young adults, though there is no limit to the age or skill required to enjoy the game. Further, variations with non-alcoholic beverages make the game appropriate for younger people.

Also, as the game has grown in popularity, leagues have been developed, and the game has acquired a sports-like quality. There are teams, logos, and an association which governs official rules and tournaments.

SUMMARY OF THE INVENTION

It is an object of the present invention to provide an attractive table on which a variety of beverage-related games may be played, particularly a game commonly known as Beer Pong.

It is another object of the present invention for the table to facilitate the games by including customized features, such as water troughs.

It is another object of the present invention that the water troughs function with water pumps so as to move the balls used in the game from one end of the table to the other, between players, or from the playing field to the player.

An advantage provided by the present invention is that it reduces time and effort spent by players chasing after balls that have left the playing area. The water flowing towards the players in the troughs facilitates sending the ball to the next player. Additionally, the water in the trough washes the ball, thereby eliminating the need for separate cleansing via a traditional "water cup".

An additional feature and advantage to having troughs built into the table includes providing a place to store empty cups as they are removed from the game. Further, by adding ice to the trough, they are ideal for storing cans or bottles of beverages, prior to filling the cups for use while playing the game.

It is a common drawback to playing games with beverages that some will spill on the playing area. Having the built-in troughs with flowing water will provide a place for the spilled liquid to drain. In some embodiments, the table will have a lip around the perimeter of the table to help prevent spills from flowing off the table and reaching the floor.

The subject game table apparatus comprises a generally flat play surface configured for placement between opposing players. The play surface is preferably rectangular in shape and is equipped with at least one water trough set into a channel in the top side of the table. The trough is parallel and proximal to a side edge of the table and near but outside of a generally central play area. The water trough has a drain at one end and a nozzle at the opposite end of the trough, such that liquid will flow from the nozzle end of the trough to the drain end. The trough is configured to collect and rinse thrown play pieces, usually balls, and return such objects to a player located near the drain end of the trough. The trough further has a liquid pump and tubing configured to convey flowing water from the trough drain to the opposite nozzle, for recirculation.

The game table preferably has at least a second channel and water trough parallel to the first trough at the table side edge opposite the first trough. In this two-trough configuration, the second trough has a liquid flow direction opposite of the first trough. Therefore, the second trough is effective for collecting, rinsing and returning a thrown play piece to the opposing player.

A most preferred embodiment of the game table has a plurality of channels and water troughs comprised of a first pair of parallel troughs, each trough beginning at a near end of the game table and thereafter extending along opposite sides of the table toward and terminating proximal to the midpoint of the table between opposite ends thereof. The first pair of parallel troughs each have a drain at a near end, tubing and a pump mechanism connected to the drain and effective for delivering liquid to a nozzle at the far end of each trough and are adapted for directing a flow of liquid down the trough in the direction of the player at the near end of the table. The troughs are further configured to collect, rinse and deliver a thrown play piece to a player at the near end of the table. The table in this preferred embodiment further comprises a second pair of parallel troughs, each trough beginning at a far end of the game table and thereafter extending along opposite sides of the table toward and terminating proximal to the midpoint of the table between opposite ends thereof, wherein the second pair of parallel troughs each have a drain, tubing and a pump mechanism connected to the drain and effective for delivering liquid to a nozzle at an end of each trough and adapted for directing a flow of liquid down the trough in the direction of a second player at the far end of the table. Again, the second pair of troughs at the far end of the subject gaming table are further configured to collect, rinse and deliver a thrown play piece to a player at the far end of the table.

The game table troughs are preferably configured such that water is pumped into the trough at the end of the trough closer to the middle line of the table, and the drain is located near the end of the table, closer to the player location.

In preferred embodiments, each water trough is removable to facilitate cleaning, maintenance and replacement as may be necessary.

The game table surface may be sealed to prevent water damage.

The game table may further comprise a rubber sealing ring installed between the trough edge and the table channels to ensure a water-tight seal between the table and the removable trough.

The game table may be fabricated to provide a hard horizontal playing surface is selected from the group consisting of hard wood, plastic resin, plastic laminates and metal surfaces.

The game table may further comprise a filter connected between a trough drain and pumping mechanism.

The game table may be configured to permit a player to direct water flow as may be desired.

The game table is preferably configured so that balls used during the course of a game may be collected in the water trough, and moved towards the players while being cleaned.

Preferred embodiments of the subject game table will have a plurality of legs adapted for holding the table level at a game playing height. The bottom of each leg of the table, may include an adjustable foot, to facilitate the leveling of the table on uneven floors. An alternative design may utilize surface mounting apparatus adapted for use of the table without the addition of table legs.

In other preferred embodiments, the game table will incorporate decorative elements, such as decorative lighting within the water trough. The decorative lighting is preferably selected from light emitting diode or electroluminescence lighting sources.

In some embodiments, each water trough will have an independent self-contained water pump and filter arrangement and further comprising valves to stop the water flow and permit cleaning of the pumps and filters.

Optionally, bubble levels may be incorporated, e.g. one on each edge of the table, to facilitate leveling of the table and to facilitate proper water flow.

Another option is to include fans built into each end of the table, providing an air stream in which a player may dry the ball after taking it from the water trough.

Other objects, features and advantages of the present invention will be apparent when the detailed descriptions of the preferred embodiments of the invention are considered with reference to the accompanying drawings, which should be construed in an illustrative and not limiting sense as follows:

DETAILED DESCRIPTION OF THE PREFERRED EMBODIMENTS

The subject invention is a table optimized for playing games involving beverages in lightweight cups and lightweight balls. Usually, players will use 16 oz. plastic cups available at any grocery store, though any size or style cup can be used. Also, usually the lightweight balls used will be ping pong balls, or table tennis balls, however it will be seen that the size and type of ball could vary. The invention comprises a table having at least one water trough, though, in most embodiments 2 or 4 water troughs is preferred. The water trough will essentially be a waterproof plastic insert set into a channel carved into the top side of the table, having a drain at one end and a nozzle at the other, such that water, or any other suitable desired liquid, will flow from one end of the trough to the other. The water trough will be preferably configured such that the water is pumped using any conventional water pump apparatus into the trough at the end of the trough closer to the middle line of the table, and the drain will be located in the bottom of the trough near the end of the table, closer to where the player stands. The subject water troughs will be removable to facilitate cleaning, maintenance or replacement. In order to prevent water damage to the wood table construction elements, the wood is sealed with a coating, such as polyurethane. Additionally, a rubber ring is installed between the trough edge and the table channels to ensure a water-tight seal between the table and the removable trough.

Typically, when playing games involving beverages, cups and balls, players choose beer as the beverage. The idea of the game is to bounce or toss the ball into a cup containing the beverage, thereby forcing the opposing player to drink the beverage. The balls tend to get sticky or dirty after being in the beer, and can sometimes fall to the floor, and pick up additional dirt. It is therefore desired to clean the balls before each toss. Prior to the subject design, players keep an extra cup of water at one end of the table to wash the balls between tosses, however, these can easily get knocked over, become contaminated, and do not add any fun value to the game or apparatus. The table is designed to have a built-in ball washer, with the additional water pump and filter, such that the balls may be kept clean and the water is kept clean. Additionally, as the water flows through the trough, in the specific configuration disclosed, balls used during the course of the game may be collected in the water trough, whereby they will be moved towards the players while being cleaned.

Figure 1:
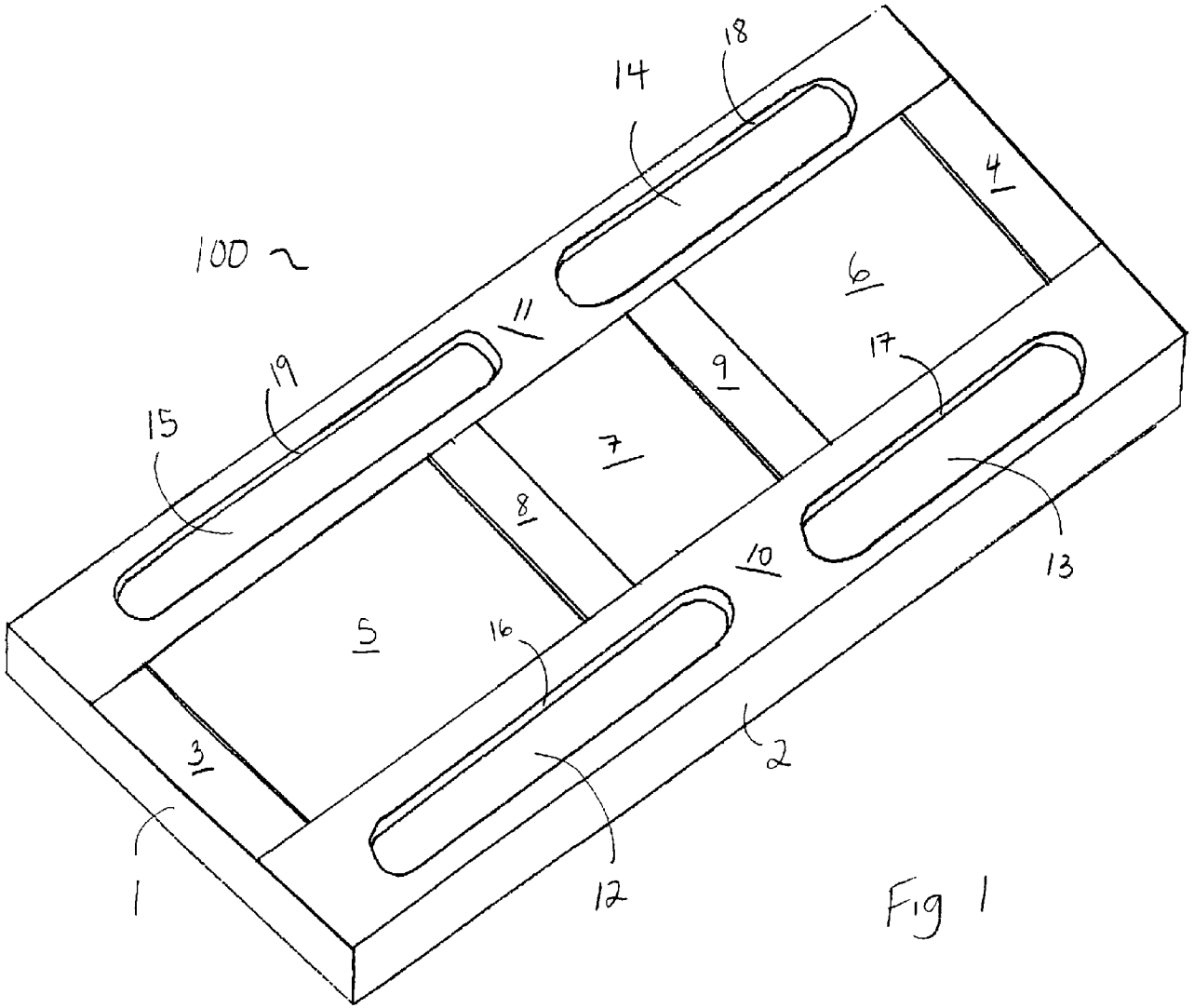
FIG. 1 is a perspective view of the top side of the table.

FIG. 1 is a perspective view of the top side of the table component 100 of the subject invention. FIG. 1 shows the table component 100 having opposite ends for players and opposite parallel side elements along the length dimension of the table into which the water trough assemblies may be installed as described herein. The table top consists of several sections, including end sections 3 and 4, play areas 5 and 6, central section 7, and bars 8 and 9. Panels 10 and 11 in particular are inlaid panels having a plurality of cut or carved elongated openings, 12 and 13 and 14 and 15, which function as the tops of the water troughs installed below each opening. Each element of the table component 100 is ideally constructed of any type of hard wood, though it is contemplated that other materials such as plastics or metals may be used. After assembly of the table top is completed, it will be recognized that a variety of decorative methods may be applied to the play areas, e.g. prints, paintings, decals, photographs etc. The table top may then be finished with a layer of resin or polyurethane to set the optional decoration, seal and waterproof the table components' material, and provide a smooth and level playing area. An alternative embodiment may utilize a decorative resin laminate which is both durable and attractive. A further decorative option is including LED lights which may be embedded in the table surface or directly within the water troughs. Additional lighting options are possible, including other types of light sources, such as electroluminescent light, including glow sticks, wires, panels or tapes.

Figure 2:
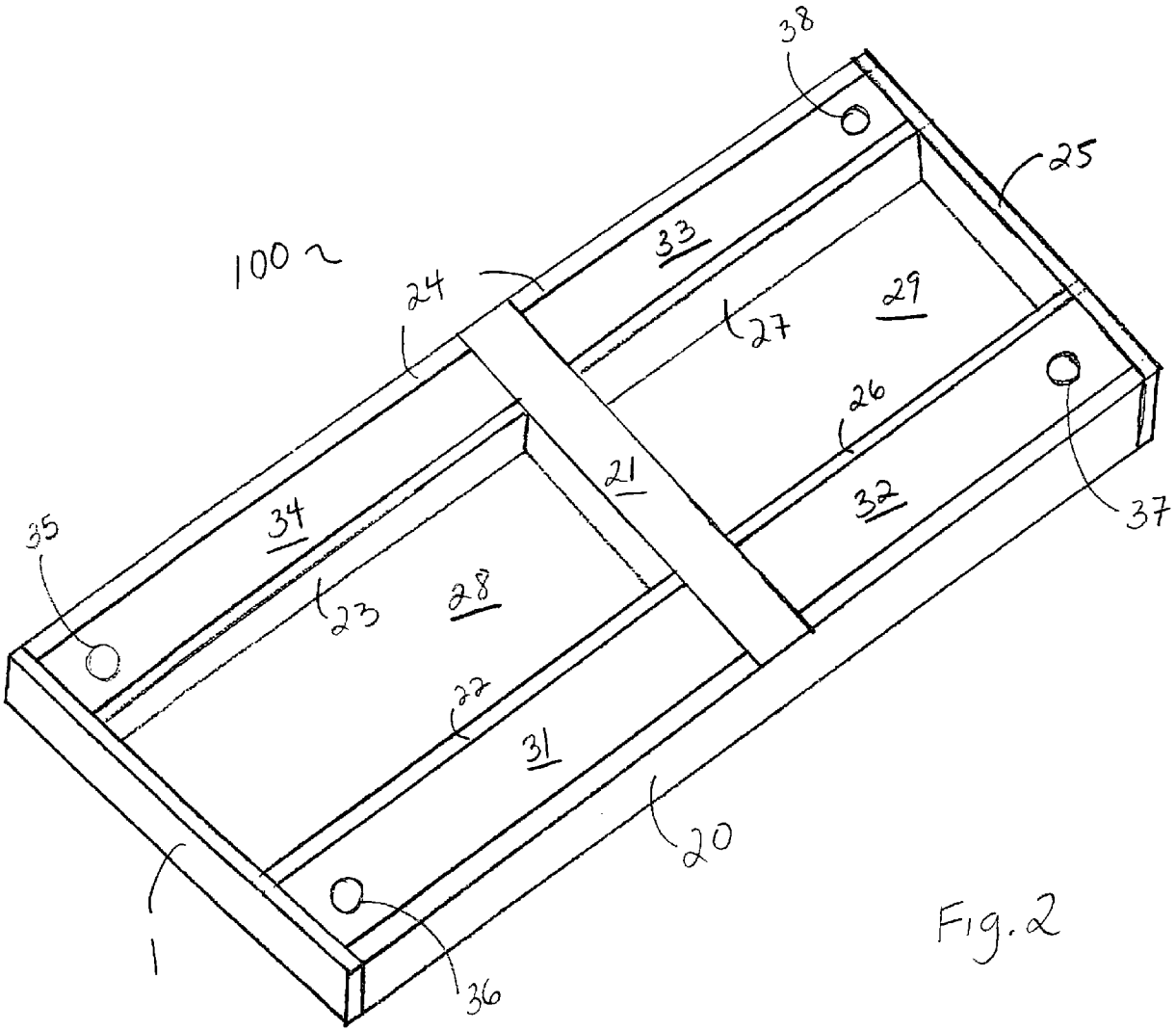
FIG. 2 is a perspective view of the bottom side of the table component of the invention.

FIG. 2 is a perspective view of the underside of the table component of the subject invention as depicted in FIG. 1. In this view, end piece 1 is still in view, and side piece 20 is now seen. This view shows each of 4 water troughs 31, 32, 33, and 34, are installed into the bottom of the table. Each trough is fabricated of any waterproof rigid material, such as extruded polyethylene thermoplastic (HDPE), and is removable so that they may be removed and cleaned as needed. Further depicted in this view, drains 35, 36, 37, 38, are shown, located in the bottom of each trough, at the players' ends of the table. The troughs may be affixed to the tables via fasteners such as screws, nuts and bolts, track and runners, snap hinges, or any other suitable means of removably affixing the troughs to the table.

Figure 3:
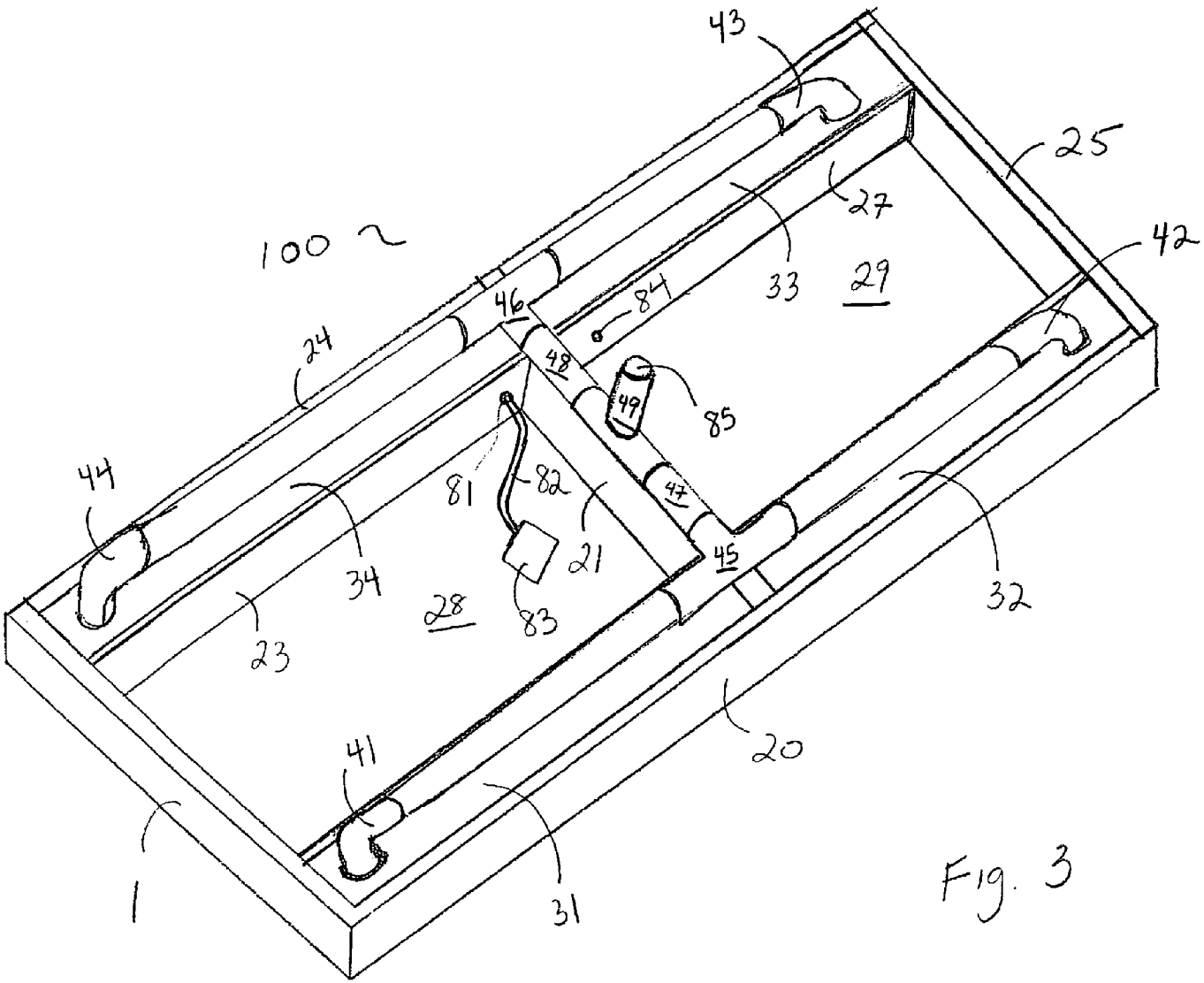
FIG. 3 is a perspective view of the bottom side of the table component of the invention including a portion of the liquid moving apparatus.

FIG. 3 is a perspective view of the bottom side of the table component of the invention including one embodiment of the liquid moving apparatus. In this embodiment, the apparatus involves connecting one conventional water pump (not shown) to all four water troughs. Plastic tubing, such as PVC pipes, is attached to each drain, and then lead via elbow fittings, straight pipes, and tee fittings, to a single central drain 85, which allows the water to drain into a bucket stored under the table (not shown). Within the bucket is a conventional pump 83, which in this embodiment feeds water through 4 plastic tubes to an entry port in each trough. In the figure, one of the tubes, 82, is shown between the pump 83 and the entry port 81. Corresponding entry port 84 can be seen in this view, although the corresponding tubes have been left out for clarity in the figure, but are otherwise similar to the example shown.

Plastic tubing, such as commercially available PVC plumbing pipes is particularly useful in this application for liquid flow. Conventional small water pumps may be utilized and either 120V models or low voltage (and battery) models may be added as desired.

It is possible, though not preferred, that the water may be directed to run in the troughs in the opposite directions, or in a circular pattern; or away from each player and toward the center of the table where a referee may be stationed.

An alternate embodiment has each water trough having its own self-contained water pump and filter, such that each table has 4 water troughs, 4 pumps and 4 filters and includes valves to stop the water flow to permit cleaning of the pumps and filters when necessary.

Figures 4, 5, 6:
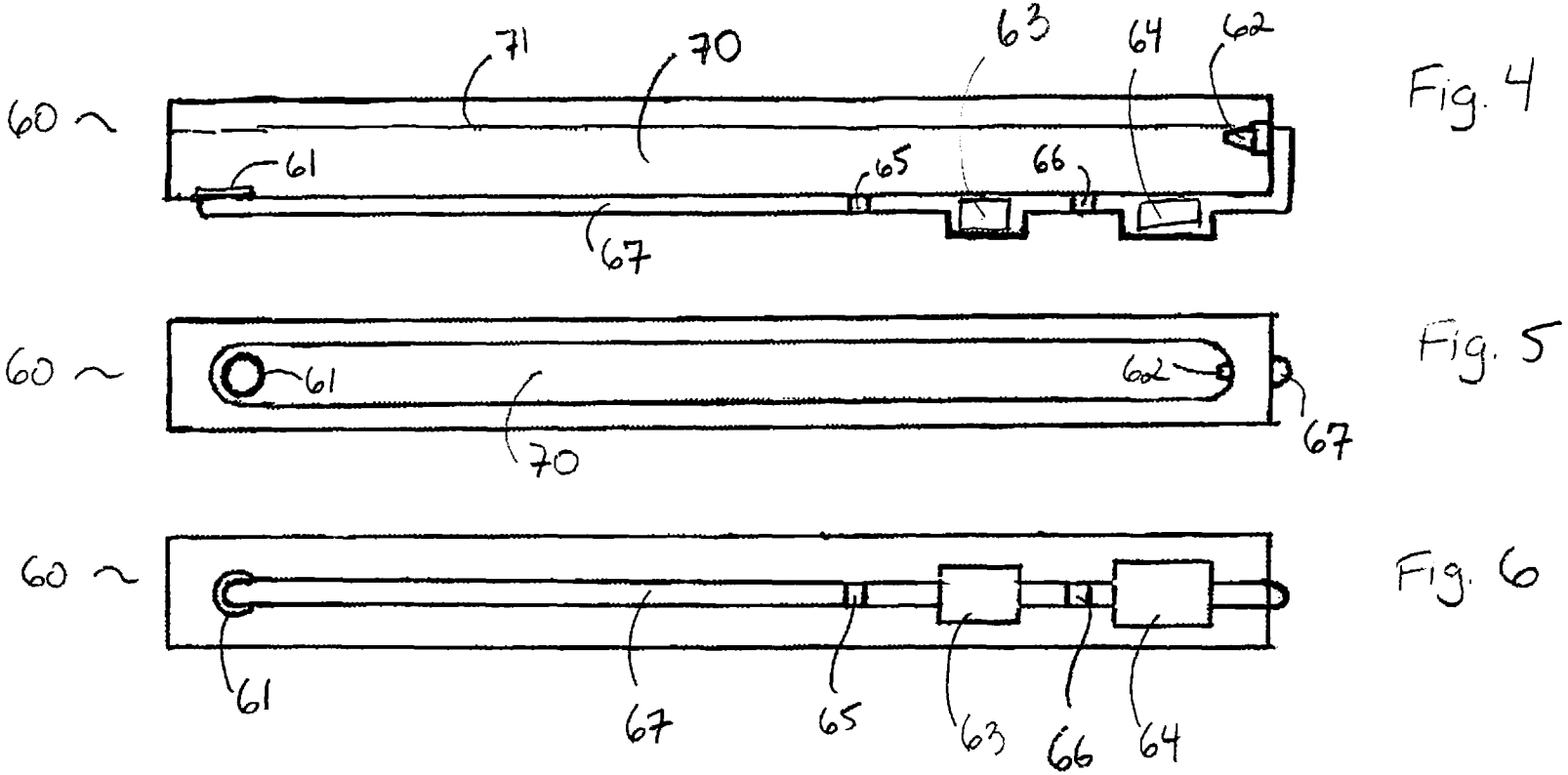
FIG. 4 is a cross-sectional view of the side of a single water trough.
FIG. 5 is an elevated view of the top of a single water trough.
FIG. 6 is an elevated view of the bottom of a single water trough.

FIG. 4 is a cross-sectional view of the side of a single water trough that is contemplated as an alternate embodiment. In this embodiment, the water flows through the drain 61 into pipe 67 located under of the trough, through a valve 65, a filter 63, another valve 66, the pump 64, and through nozzle 62 back into the trough. In this embodiment, each trough has its own pump and filter, which will facilitate repairs and maintenance. Valves, tubing and nozzles may be selected from conventional low pressure water pumping equipment.

FIG. 5 is an elevated view of the top of a single water trough as described in FIG. 4.

FIG. 6 is an elevated view of the bottom of a single water trough as described in FIG. 4.

Figure 7:
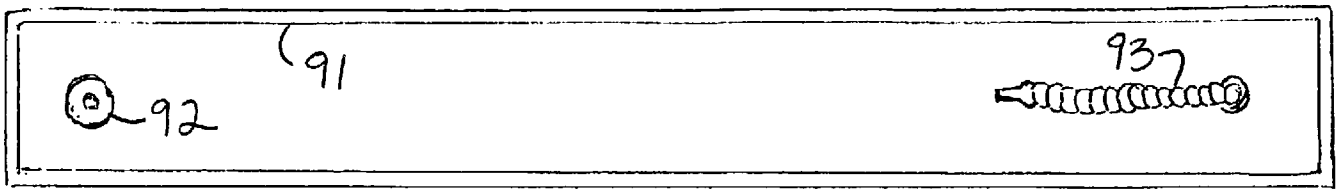
FIG. 7 is a top plan view of an alternative single water trough.

FIG. 7 is a top plan view of an alternative water flow system 90. In this embodiment, trough 91 has a drain 92 built into the bottom of the trough near one end and a nozzle 94 attached to flex tube 93 entering the trough near the opposite end. This alternative flex tube 93 can be made out of a variety of materials, including a rigid thermoplastic. The preferred construction is of a stiff but flexible thermoplastic, such as a heavy-duty bending straw type plastic, such that the tube may be oriented in a variety of directions allowing the water flow to be directed in a variety of directions. This flex tube 94 and nozzle 93 configuration will permit a user to be more playful and creative with the water flow on the table, including by shooting the water from one trough into another trough, and creating cross streams across the playing surface.

Figure 8:
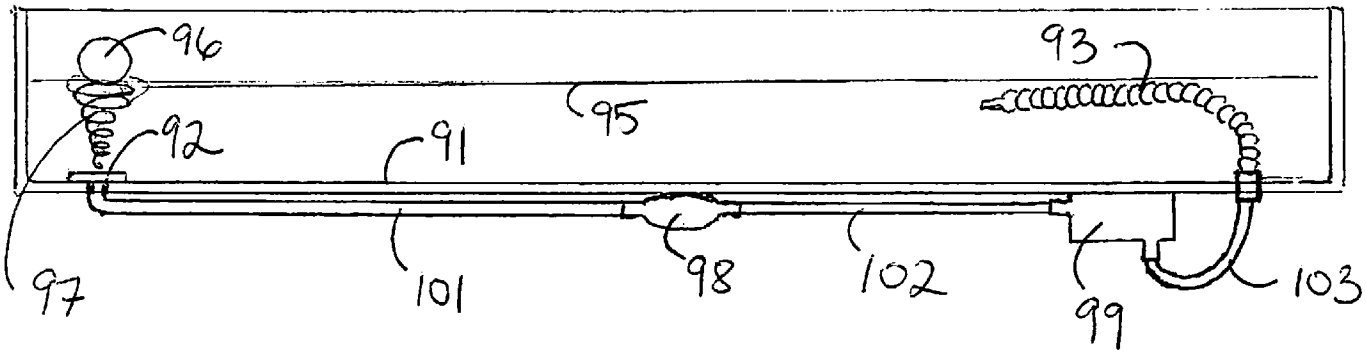
FIG. 8 is a cross-sectional view of the alternative water trough of FIG. 7.

FIG. 8 is a cross-sectional view of the water flow system 90 shown in FIG. 7. In this view, the water 95 is present, as well as the ball 96 used in the game. The ball 96 floats in the water just over the drain 92, held in place by forces of water flow 97 and buoyancy. Further seen in this view is the combination primer pump and filter 98, such as those found on conventional gasoline powered engines, and the motorized water pump 99. The water flows through the pipes 101, 102 and 103 as the water pump 99 creates a flow in the water flow system 90. The pipes are contemplated to be made of any suitable waterproof materials, preferably a plastic such as PVC pipes, or alternatively, rubber tubing. Particularly, rubber tubing would be most suitable for connecting the water pump 99 to the trough 91 via pipe 103.

Figure 9:
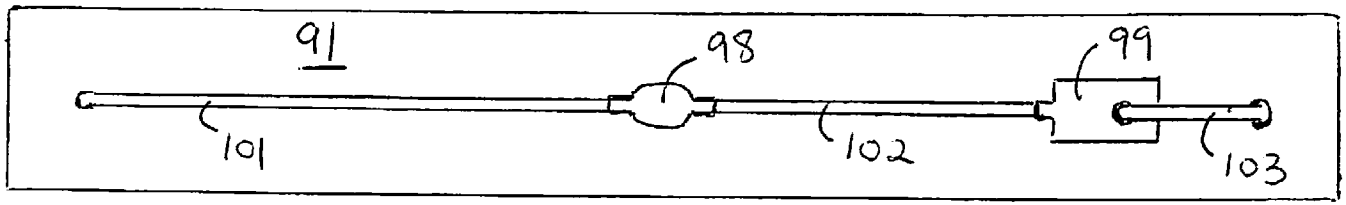
FIG. 9 is a bottom plan view of the alternative water trough of FIG. 7.

FIG. 9 is a bottom plan view of the water flow system 90. In this view again seen are the pipes 101, 102, and 103, the combination primer pump and filter 98, and the motorized water pump 99.

Example

A wooden table was made in accordance with the described specifications having dimensions of 8 feet in length and 30 inches in width. Two pairs of watertight troughs were attached to channels in the tabletop surface on opposite sides and ends of the game table. Each trough had a drain at the ends closest to the players and a nozzle at the opposite end of each trough. The drain and nozzle pairs were connected to plastic tubing and a liquid pump adapted to facilitate water flow through each trough. During gameplay utilizing ping pong balls, the balls were collected in the troughs, rinsed with water and conveyed toward the drain end of the troughs for further play.

The length, width and height of finished tables can vary without departing from the scope of this invention, as desired for different levels and skills of players.

Other features of the subject table design are a plurality of bubble levels, one on each edge of the table to facilitate finding the leveled position of the table, to achieve proper water flow. In addition, at the bottom of each leg of the table, is an adjustable foot, to facilitate the leveling of the table on potentially uneven floors.

Another feature of the subject design includes having a small fan built into each corner of the table, providing an air stream in which a player may dry the ball after taking it from the water trough.

It will be appreciated that the game equipment described is intended for use only by adults, and an adult capable of supervising the use thereof should be available at all times the equipment is utilized.

The invention now being fully described, it will be apparent to one of ordinary skill in the art that many changes and modifications can be made thereto without departing from the spirit or scope of the invention as set forth herein.

The invention claimed is:

1. A game table comprising: a generally flat play surface configured for placement between opposing players, wherein the play surface is equipped with at least one water trough set into a channel in the top side of the table play surface parallel and proximal to a side edge of the table and outside of a generally central play area, the water trough having a drain at one end and a nozzle at the opposite end of the trough, such that liquid will flow from the nozzle end of the trough to the drain end wherein the trough is configured to collect and rinse thrown play pieces and return such objects to a player located near the drain end of the trough, the trough further comprising a liquid pump and tubing configured to convey flowing water from the trough drain to the opposite nozzle for recirculation.

2. The game table of claim 1 further comprises a second channel and water trough parallel to the first trough at the table side edge opposite the first trough and having a liquid flow direction opposite of the first trough wherein the second trough is effective for collecting, rinsing and returning a thrown play piece to the opposing player.

3. The game table of claim 1 having a plurality of channels and water troughs comprised of (a). a first pair of parallel troughs each trough beginning at a near end of the game table and thereafter extending along opposite sides of the table toward and terminating proximal to the midpoint of the table between opposite ends thereof, wherein the first pair of parallel troughs are each comprised with a drain at a near end, tubing and a pump mechanism connected to the drain and effective for delivering liquid to a nozzle at the far end of each trough adapted for directing a flow of liquid down the trough in the direction of the player at the near end of the table and further configured to collect, rinse and deliver a thrown play piece to a player at the near end of the table; and (b). a second pair of parallel troughs each trough beginning at a far end of the game table and thereafter extending along opposite sides of the table toward and terminating proximal to the midpoint of the table between opposite ends thereof, wherein the second pair of parallel troughs are each comprised with a drain, tubing and a pump mechanism connected to the drain and effective for delivering liquid to a nozzle at an end of each trough and adapted for directing a flow of liquid down the trough in the direction of a second player at the far end of the table and further configured to collect, rinse and deliver a thrown play piece to a player at the far end of the table.

4. The game table of claim 1 wherein the trough is configured such that water is pumped into the trough at the end of the trough closer to the middle line of the table, and the drain is located near the end of the table, closer to the player location.

5. The game table of claim 1 wherein each water trough is fabricated of waterproof rigid material and is removable to facilitate cleaning, maintenance and replacement.

6. The game table of claim 1 wherein the table surface is sealed to prevent water damage.

7. The game table of claim 1 further comprising a rubber sealing ring installed between the trough edge and the table channels to ensure a water-tight seal between the table and the removable trough.

8. The game table of claim 1 wherein the table is fabricated to provide a hard horizontal playing surface selected from a group consisting of hard wood, plastic resin, plastic laminates and metal surfaces.

9. The game table of claim 1 further comprising a filter connected between a trough drain and pumping mechanism.

10. The game table of claim 1 wherein water flow may be directed by a player as may be desired.

11. The game table of claim 1 configured so that balls used during the course of a game may be collected in the water trough, and moved towards the players while being cleaned.

12. The game table of claim 1 further comprising a plurality of legs adapted for holding the table level at a game playing height.

13. The game table of claim 12 further comprising a plurality of, at the bottom of each leg of the table, an adjustable foot, to facilitate the leveling of the table on uneven floors.

14. The game table of claim 1 further comprising surface mounting apparatus adapted for use of the table without the addition of table legs.

15. The game table of claim 1 further comprising decorative lighting within the water trough.

16. The game table of claim 15 wherein the decorative lighting is selected from light emitting diode or electroluminescence lighting sources.

17. The game table of claim 1 wherein each water trough has an independent self-contained water pump and filter arrangement and further comprises valves to stop the water flow and permit cleaning of the pumps and filters.

18. The game table of claim 1 further comprising a plurality of bubble levels, one on each edge of the table to facilitate finding the leveled position of the table, to achieve proper water flow.

19. The game table of claim 1 further comprising a fan built into each end of the table, providing an air stream in which a player may dry the ball after taking it from the water trough.

* * * * *